United States Patent [19]

Zaffrann et al.

[11] 4,251,700

[45] Feb. 17, 1981

[54] DISCONNECT SWITCH

[75] Inventors: Albert A. Zaffrann, Milwaukee; Robert E. Borchardt, Brown Deer; Frank A. Grabarczyk, Milwaukee, all of Wis.

[73] Assignee: Allen-Bradley Company, Milwaukee, Wis.

[21] Appl. No.: 884,888

[22] Filed: Mar. 9, 1978

[51] Int. Cl.[3] ..... H01H 33/12

[52] U.S. Cl. ..... 200/146 R; 200/260; 200/293

[58] Field of Search ..... 200/15, 50 A, 50 C, 200/146 R, 153 G, 153 H, 155 R, 164 R, 247–261, 144 R; 335/132

[56] References Cited

U.S. PATENT DOCUMENTS

| | | | |
|---|---|---|---|
| 2,281,052 | 4/1942 | Samzelius | 200/50 |
| 2,325,697 | 8/1943 | Millermaster et al. | 200/50 A |
| 3,180,963 | 4/1965 | Hales et al. | 200/261 X |
| 3,496,319 | 2/1970 | Norden | 200/146 R |
| 3,632,935 | 1/1972 | Stegmaier | 200/155 R |
| 3,684,849 | 8/1972 | Zubaty | 200/144 R X |
| 3,840,717 | 10/1974 | Pekrul et al. | 200/15 X |
| 3,949,333 | 4/1976 | Freitag et al. | 335/132 |
| 3,958,095 | 5/1976 | Zaffrann et al. | 200/293 |
| 3,959,615 | 5/1976 | Zaffrann, Jr. et al. | 200/153 H |

*Primary Examiner*—James R. Scott

*Attorney, Agent, or Firm*—Quarles & Brady

[57] ABSTRACT

A disconnect switch includes a crossbar assembly having an arm at each of its ends which rotatably fastens the assembly to a frame for swinging motion around a pivot axis. Three movable contact assemblies are carried by the crossbar between a closed position in which their line side ends engage stationary contacts and an opened position in which their line side ends are disengaged. Stationary connectors aligned along the pivot axis engage the load side ends of the movable contact assemblies at all positions of the crossbar.

12 Claims, 7 Drawing Figures

DISCONNECT SWITCH

BACKGROUND OF THE INVENTION

The field of the invention is disconnect switches, and more particularly, manually operated disconnect switches having a set of movable contacts which are pivoted between an opened and closed position by rotating a crossbar.

In relatively small disconnect switches such as that disclosed in U.S. Pat. No. 3,958,095, a molded crossbar is mounted to a base for rotation about a horizontal axis and it carries a set of three movable contacts between an opened and closed position. The disconnect switch is typically mounted within a cabinet and is operated manually by a handle which is coupled to the crossbar by a trip mechanism such as that disclosed in U.S. Pat. No. 3,959,615. A disconnect switch made according to the teachings of the above patent offers numerous advantages over prior disconnect switches, including ease of assembly and maintenance, versatility and reliability.

Economic considerations become very important when these same advantages are to be achieved in larger disconnect switches. The larger current carrying capacity requires proportionally larger contacts, greater spacing between them and greater contact pressure. The net result is a need for a much larger and stronger supporting structure, contact structure and crossbar assembly. Cost factors preclude scaling up successful designs such as that disclosed in the above-cited patent, and new designs must, therefore, be created to achieve the same results in larger disconnect switches.

SUMMARY OF THE INVENTION

The present invention relates to a disconnect switch, and particularly, to a crossbar assembly for such a switch in which the moving contacts thereon are easily assembled and maintained. The crossbar assembly includes a metal insert having arms at each end which are rotatably fastened to the switch base to swing about a horizontal pivot axis between an opened and closed position. A set of stationary connectors mount to the base and are aligned along the pivot axis and a set of movable contact assemblies mount to the crossbar insert and are maintained in continuous electrical contact with the connectors as the crossbar insert is pivoted. The movable contact assemblies are swung into and out of engagement with stationary line contacts by this pivotal motion.

A general object of the invention is to facilitate assembly and maintenance of the movable contact assemblies. By aligning the stationary connectors along the pivot axis of the crossbar assembly, the movable contact assemblies can make sliding electrical connection therewith without the necessity of being physically fastened. Thus, to assemble or remove one of the movable contact assemblies it need only be disconnected from the crossbar assembly and pulled free.

Another aspect of the present invention is the construction of the crossbar assembly and the manner in which the movable contact assemblies are mounted to it. Crossbar strength is achieved by a metal insert around which an electrically insulating material is molded to form contact supports for the movable contact assemblies. The movable contact assemblies are comprised of one or more plate-like elements in which a slot is formed along one edge. The molded contact support is received in this slot when the movable contact assembly is mounted to the crossbar. A small retainer pin is employed to hold each movable contact assembly in place, but the major forces tending to separate it from the crossbar act on the mating engagement between the slot and the contact support.

Yet another aspect of the present invention is the structure of the movable contact assembly. Each movable contact assembly includes a pair of contact blades which are spaced apart to engage opposite sides of the stationary connector and stationary line contact. Contact pressure is maintained by plate-like bias springs fastened to the outer sides of each contact blade to provide an inward directed force which "pinches" the stationary line contact and stationary connector between the contact blades.

A more specific object of the invention is to provide a disconnect switch of modular design. Each pole of the switch is comprised of elements, including an insulating base module which are interchangeable.

The foregoing and other objects and advantages of the invention will appear from the following description. In the description reference is made to the accompanying drawings which form a part hereof, and in which there is shown by way of illustration a preferred embodiment of the invention. Such embodiment does not necessarily represent the full scope of the invention, however, and reference is therefore made to the claims herein for interpreting the scope of the invention.

DESCRIPTION OF THE PREFERRED EMBODIMENT

Figure 1:
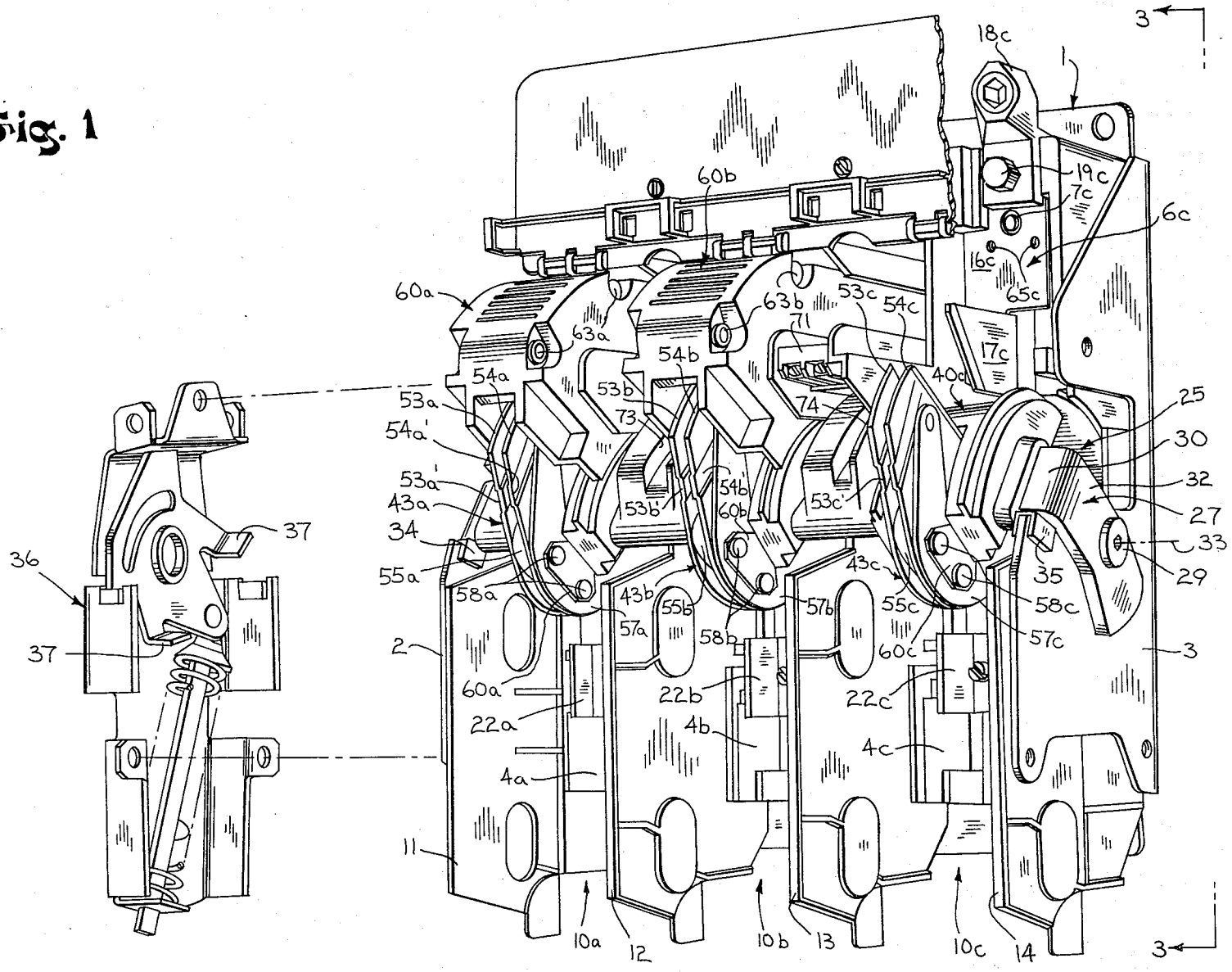
FIG. 1 is a perspective view with parts removed of the disconnect switch of the present invention.

Referring particularly to FIGS. 1–4, the disconnect switch of the present invention is formed by mounting modular elements to a metal mounting frame 1 that is suitable for mounting to the back wall of an enclosure or other supporting structure. The mounting frame 1 includes integral side walls 2 and 3 which extend forward from each of its respective sides to define a cavity therebetween.

Mounted within this cavity are three molded base modules 4*a*, 4*b* and 4*c* which are positioned alongside each other and which occupy nearly the entire vertical and horizontal extent of the cavity. The base modules 4 are molded from an electrically insulating thermoset phenolic material and each is held in place by a set of bolts 5*a*, 5*b* or 5*c*. Each base module 4 provides support for a line terminal assembly 6 which is mounted to its upper end by means of screw assemblies 7 that extend through the module 4 from its back surface. Each module 4 also provides support for a load terminal assembly 8 which is mounted to its lower end by screw assemblies 9 that also extend through the module 4 from its back surface.

The lower portion of the cavity defined by the side walls 2 and 3 is divided into three compartments, indicated generally at 10*a*, 10*b* and 10*c*, by a set of vertical barriers 11–14. The barriers 11–14 are molded from an electrically insulating thermoplastic, flame retardant, polypropylene material and they are mounted to the base modules 4*a*–4*c*. More particularly, the barrier wall 11 is received and fastened in place along the left-hand side of the base module 4*a*, the barrier 12 is fastened in place along the right-hand side of the base module 4*a*, the barrier 13 is fastened in place along the right-hand side of the base module 4*b*, and the barrier 14 is fastened in place along the right-hand side of the base module 4*c*. The compartments 10*a*–10*c* which are thus formed, house and electrically insulate the line terminal assemblies 6 from one another.

Figure 2:
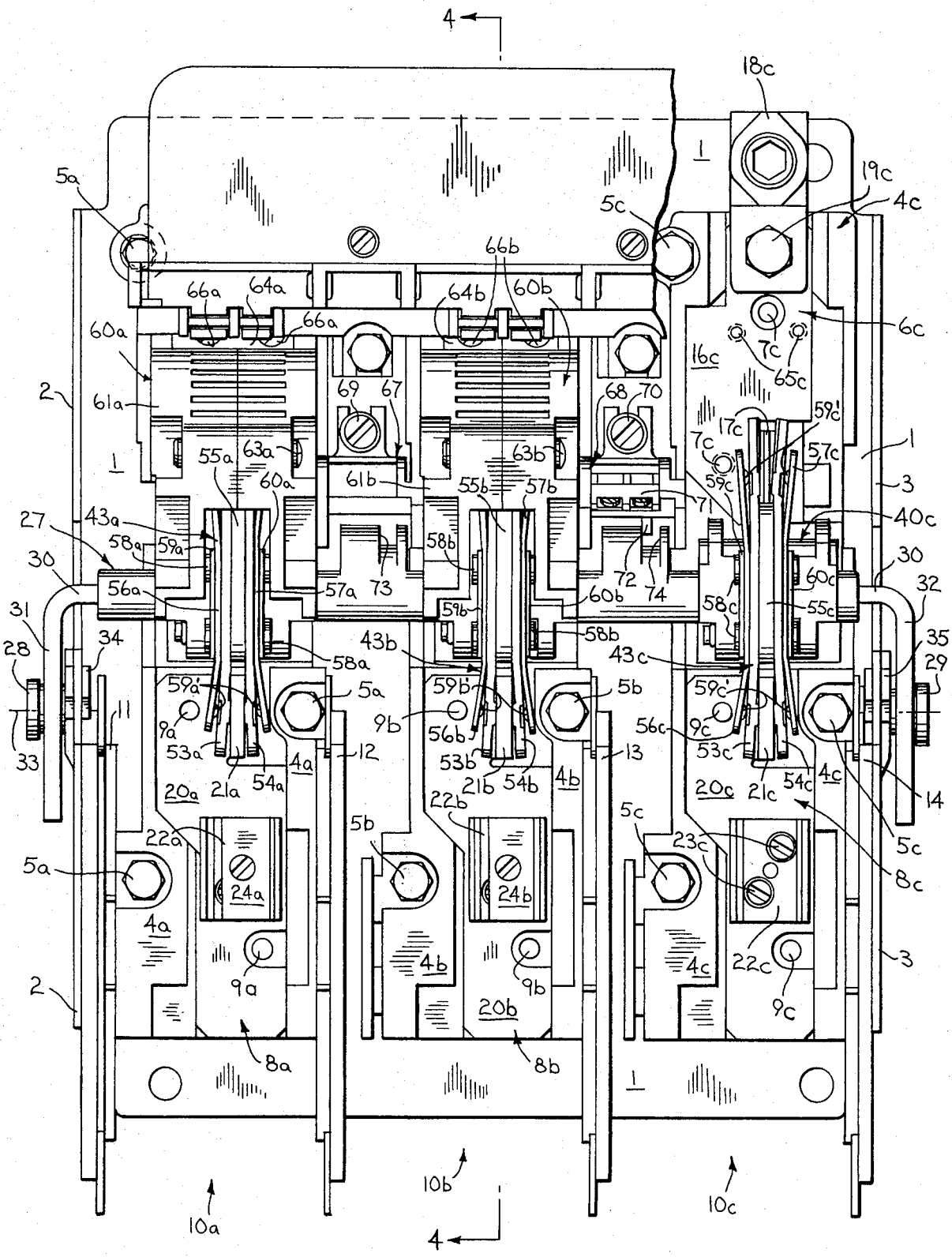
FIG. 2 is a front elevation view of the disconnect switch of FIG. 1 taken along the line 3—3.
Figure 3:
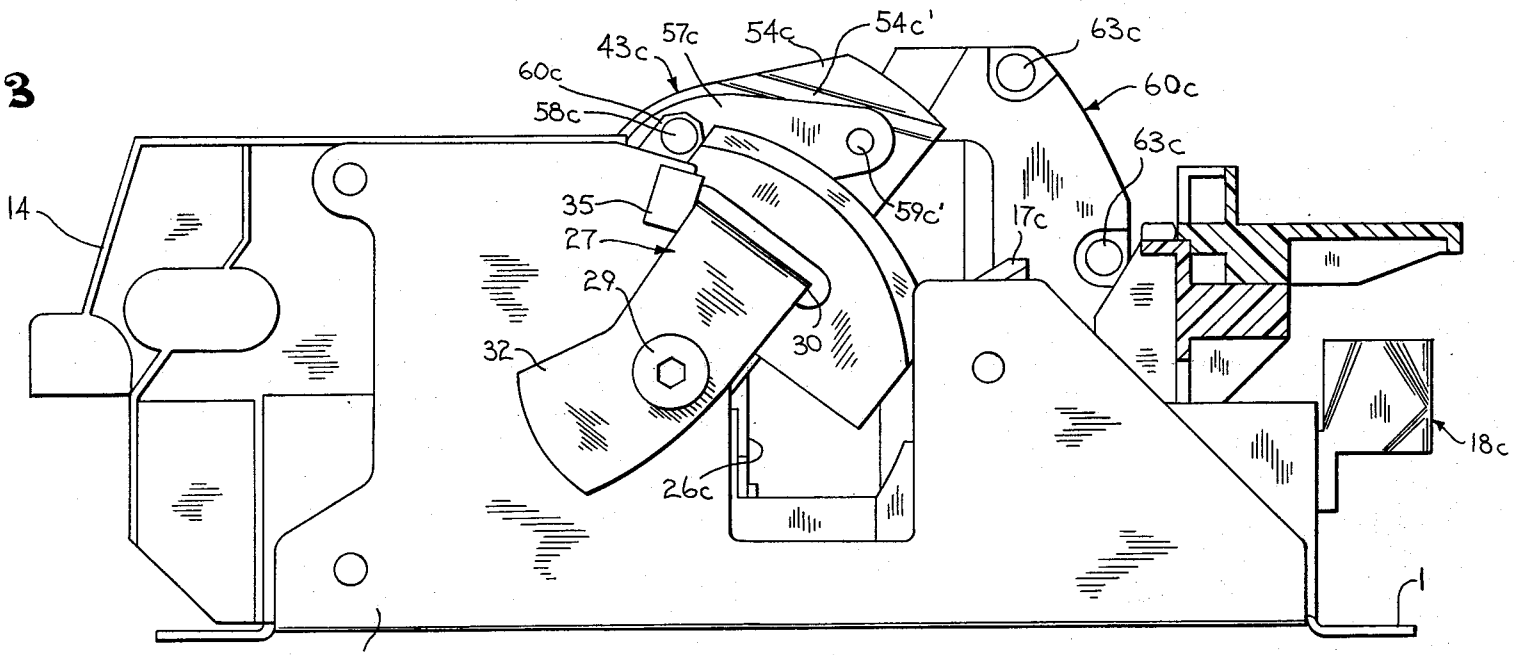
FIG. 3 is a side elevation view of the disconnect switch of FIG. 1.
Figure 4:
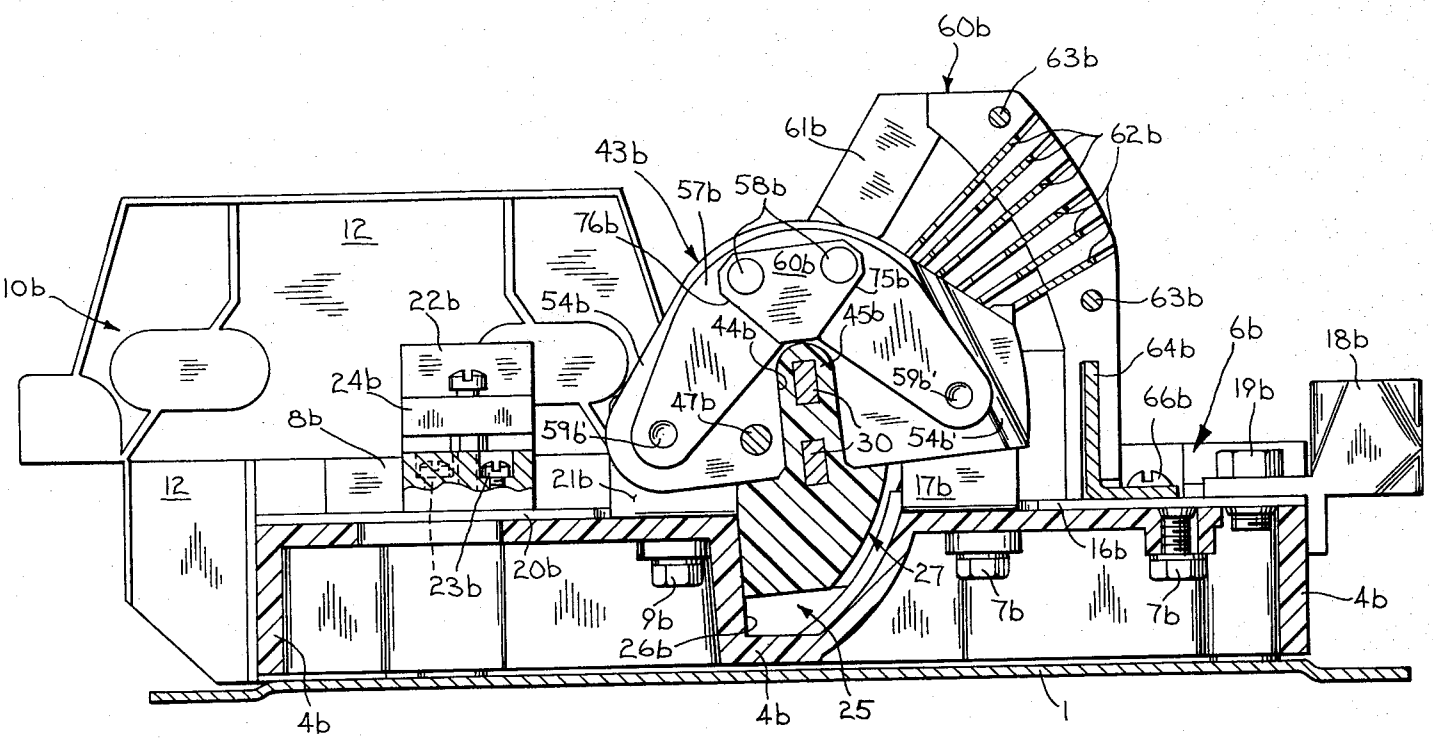
FIG. 4 is a view in cross section with parts shown in whole taken along the line 4—4 in FIG. 2.

Referring particularly to FIGS. 1, 2 and 4, the line terminal assemblies 6 are each comprised of a metal plate which is shaped to form a flat bus portion 16 that lies against the front surface of its supporting base module 4, and a forward extending stationary contact portion 17. A line pressure connector 18 is fastened to the top end of the plate by a bolt 19 and power lines (not shown in the drawings) may be clamped thereto for delivery of three-phase power to the switch.

Referring particularly to FIGS. 2 and 4, the load terminal assemblies 8 are each comprised of a metal plate which is shaped to form a flat bus portion 20 that lies against the front surface of its supporting base module 4, and a forward extending stationary connector portion 21. A fuse clip 22 is fastened to the bus portion 20 at its lower end by a pair of screws 23 and it includes a clamping member 24 which is suitable for securing one end of a fuse (not shown in the drawings).

Each of the three base modules 4 thus supports a stationary contact 17 near its upper end and a stationary connector 21 located beneath the stationary contact 17 in a common vertical plane. As shown best in FIG. 4, the stationary contact 17 is spaced from the stationary connector 21 a substantial distance and a depression in the base module 4 forms a channel 25 therebetween. As will now be described, electrical connection is made between the contact 17 and connector 21 by a movable contact which is carried by a crossbar assembly 27 that seats within the channel 25 when rotated to a closed position.

As shown best in FIGS. 1–4, the crossbar assembly 27 extends across the entire front of the disconnect switch and is rotatably anchored at each of its ends to the side walls 2 and 3 by respective pivot pins 28 and 29. The crossbar assembly 27 includes a metal insert 30 which is bent at each end to form arms 31 and 32 that receive the pins 28 and 29. The pins 28 and 29 are aligned along a horizontal pivot axis 33 which passes through each of the three stationary connectors 21 *a–c*, and the insert 30 is spaced radially outward from this axis 33 and pivots thereabout between an opened position shown in FIGS. 1 and 3, and a closed position shown in FIGS. 2 and 4. In the opened position the insert 30 engages stops 34 and 35 which are mounted to the respective side walls 2 and 3 and in the closed position the crossbar assembly 27 engages stops 26 formed in the channels 25 of the base modules 4.

Referring to FIG. 1, rotation of the crossbar assembly is accomplished by a trip mechanism 36 which may be mounted to either side wall 2 or 3. The trip mechanism includes a drive plate having a pair of ears 37 which engage opposite edges of the crossbar arm 31 or 32 and which are swung by the actuation of the trip mechanism 36 to pivot the crossbar assembly 27. The trip mechanism 36 is a snap action toggle mechanism and the details of its structure and operation are disclosed in U.S. Pat. No. 3,959,615 issued on May 25, 1976 and entitled "Trip Mechanism for Disconnect Switch."

Figure 6:
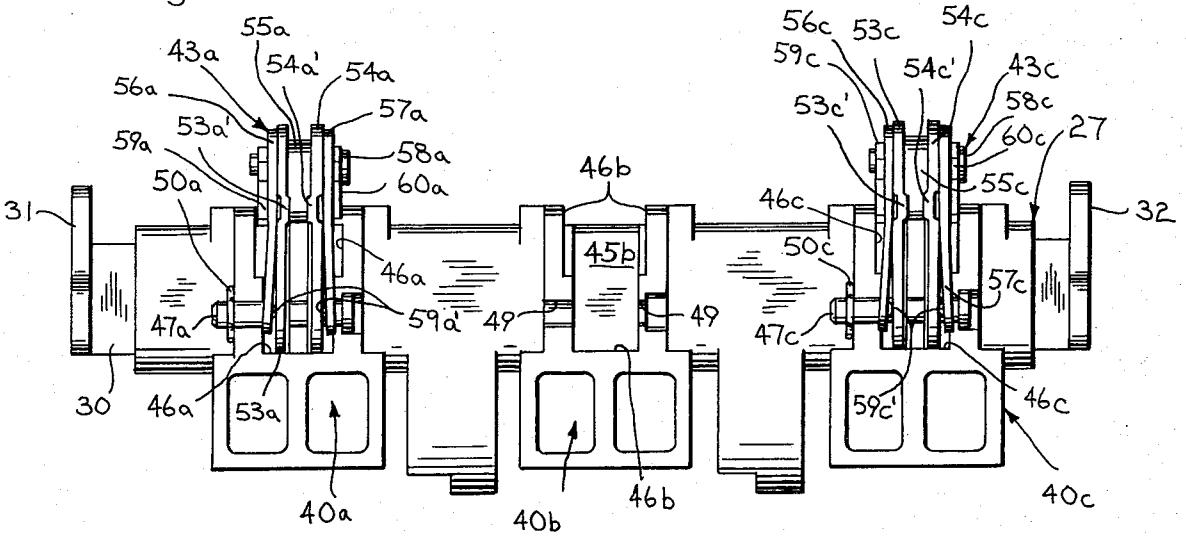
FIG. 6 is a bottom view of the crossbar assembly of FIG. 5.
Figure 5:
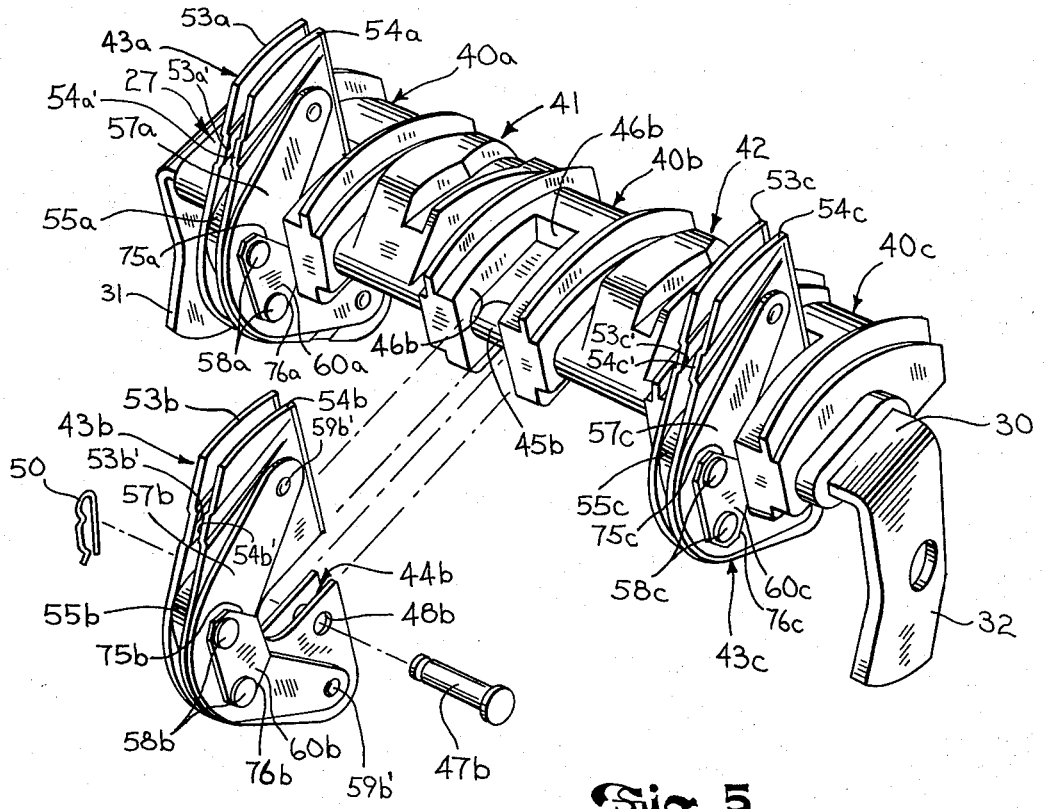
FIG. 5 is a perspective view with parts exploded of the crossbar assembly which forms part of the disconnect switch of FIG. 1.
Figure 7:
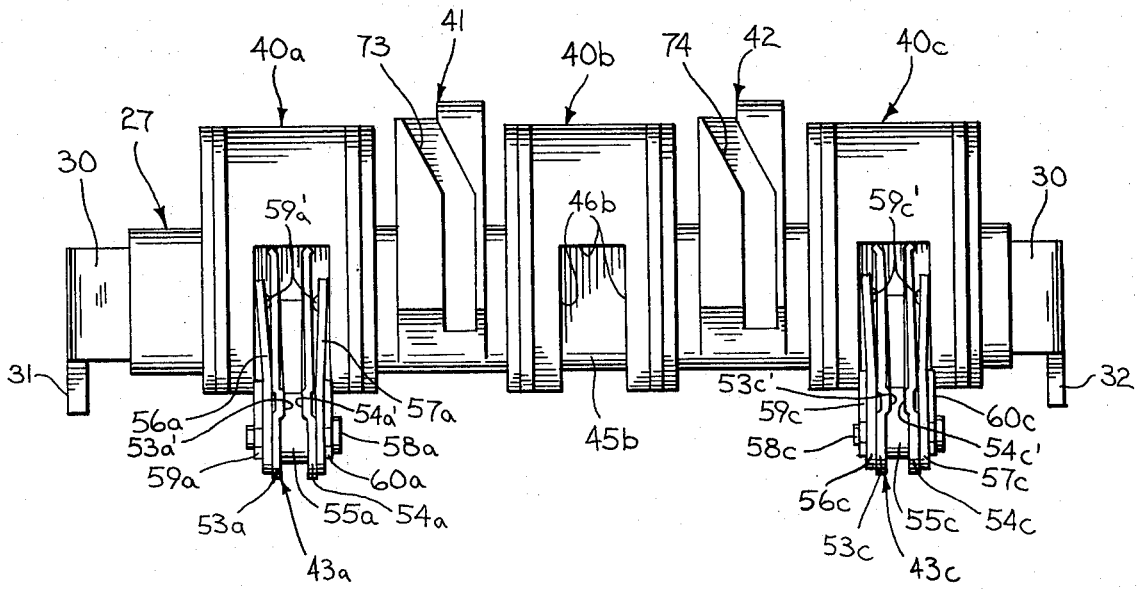
FIG. 7 is a top view of the crossbar assembly of FIG. 5.

As shown best in FIGS. 5–7, the crossbar assembly 27 includes a complex series of elements which are molded around the insert member 30 and distributed along its length. These elements include three contact support members 40 *a–c* which are aligned in the respective vertical planes of the stationary contacts 17 *a–c* and stationary connectors 21 *a–c*. Disposed between the contact support members 40 are a pair of cam members 41 and 42. The elements 40–42 are all formed in a single molding process from an electrically insulating, glass reinforced, polyester material.

Movable contact assemblies 43 *a–c* are mounted to the respective contact support members 40 *a–c*. The movable contact assemblies 43 *a–c* have a generally crescent shape and include a deep slot 44 which extends inward from one edge. Each contact support member 40 is shaped to form a boss 45 which snuggly receives the slot 44 and firmly supports the movable contact assembly 43. The boss 45 and the upstanding walls 46 which surround it restrain all relative motion of the movable contact assembly 43 except in a single withdrawal direction. As shown best in FIGS. 5 and 6, a pin 47 is inserted through an opening 48 in the movable contact assembly 43 and is received in a slot 49 which is integrally formed in the walls 46 on the underside of the contact support member 40. This pin 47 locks the movable contact assembly 43 in place over the boss 45 by preventing its withdrawal. A hitch pin 50 holds the pin 47 in place.

Each movable contact assembly 43 includes a pair of metallic contact blades 53 and 54 which are spaced apart by a metallic spacer element 55. Spring blades 56 and 57 are disposed against the outer surface of the respective contact blades 53 and 54 and the entire assembly is fastened together by rivets 58. Retainer plates 59 and 60 are sandwiched beneath the heads of the rivets 58 to confine the bending action of the blades 53, 54, 56 and 57 to their outer extremities.

Referring to FIGS. 1–4, when the crossbar assembly 27 is pivoted to its closed position the outer, or line side, end of the movable contact blades 53 and 54 engage the stationary contacts 17 to electrically connect the line pressure connectors 18 with the fuse clips 22. When the crossbar assembly 27 is pivoted to its opened position, these outer ends are swung clear of the stationary contacts 17 to break the electrical circuit. Because the stationary connectors 21 are aligned along the pivot axis 33 of the crossbar assembly 27, however, the inner, or load side, ends of the movable contact blades remain in mechanical and electrical contact with the connectors 21 at all positions of the crossbar assembly 27. Thus, although continuous electrical contact is maintained, the movable contact assemblies 43 need not be fastened to the stationary connectors 21. As a result, the movable contact assemblies 43 can easily be removed from the switch for inspection or repair merely by removing the pins 47 which retain them to the crossbar assembly 27.

As shown best in FIGS. 2 and 5, the contact blades 53 and 54 are disposed to each side of the vertical plane which passes through their associated stationary contact 17 and stationary connector 21. Ribs 53' and 54' are formed at each end of the respective blades 53 and 54 and the space between these ribs 53' and 54' is less than the thickness of the stationary contact 17 and the stationary connector 21. As a result, the ribs 53' and 54' at the outer and inner ends of the movable contact blades 53 and 54 engage and are deflected laterally outward by the stationary contact 17 and the stationary connector 21. The spring plates 56 and 57 are similarly deflected outward and the resulting bias force generates contact pressure which insures good electrical connection. Dimples 59' are formed on the extremities of the spring plates 56 and 57 to precisely locate the point at which this bias force is applied, and hence, to more precisely control the contact pressure. The magnitude of this contact pressure may be adjusted for various sized switches by altering the height of the ribs 53' and 54' or the height of the dimples 59'. In addition, the size of the retainer plates 59 and 60 can be altered to move bending edges 75 and 76 thereon closer to or further away from the dimples 59'.

Referring particularly to FIGS. 1 and 4, to protect the switch elements from destructive arcing when the switch is opened, arc chutes 60 are mounted above the stationary contacts 17. Each arc chute 60 includes a case 61 which is molded from an electrically insulating, glass reinforced, polyester material, and a set of metal deionization plates 62 which are disposed in slots formed in the case 61. The case is molded in two parts which are held together by rivets 63. A metal bracket 64 is retained to the back of the case 61 and it is fastened to openings 65 in the line terminal assembly 6 by screws 66. There are numerous arc chute structures known in the art and the manner in which they function to cool and extinguish the arcs which may form when the crossbar assembly is rotated to open circuit is also well known.

Referring particularly to FIGS. 1 and 2, located between the arc chutes 60 are a pair of auxiliary contact cartridge supports 67 and 68. The supports 67 and 68 are each molded from an electrically insulating thermoset phenolic material and they are fastened in place to the mounting frame 1 by screws 69 and 70. The supports 67 and 68 are shaped to form cavities which receive and releasably retain a switch cartridge 71 such as that disclosed in U.S. Pat. No. 3,949,333 issued Apr. 6, 1976 and entitled "Auxiliary Switch for Electromagnetic Contactor." The electrical contacts inside the switch cartridge 71 are opened and closed by the sliding motion of a coupling element 72 which extends downward from its lower surface and engages a camway 73 or 74 formed in the crossbar assembly 27. As shown best in FIG. 7, the camways 73 and 74 are molded into the crossbar assembly along with the contact support member 40 *a–c* and they include a sloping portion which slides the coupling element on the switch cartridges 71 when the crossbar is pivoted between its opened and closed positions.

It should be apparent that the elements of each switch pole are identical and thus interchangeable. This "modularity" allows a reduction in the number and size of molded parts with a consequent reduction in unit cost. Also, a minimal number of replacement parts need be stocked by the user or supplier.

We claim:

1. A disconnect switch, the combination comprising:

a frame including a base formed of an electrically insulating material and a pair of spaced side walls;

a set of stationary line contacts mounted on said base in side-by-side relation;

a set of stationary connectors mounted on said base, said stationary connectors being positioned along a horizontal axis and each being positioned in a common vertical plane with an associated one of said stationary line contacts;

a crossbar having a contact carrying portion which extends across the width of the disconnect switch along a longitudinal axis which is substantially parallel to and spaced from said horizontal axis and having a pair of arms, one attached to each end of the contact carrying portion and extending laterally therefrom, each of said arms being rotatably fastened to one of said pair of spaced side walls at a point along side horizontal axis to enable said contact carrying portion to swing about said horizontal axis.

a set of contact support members formed on said crossbar and spaced along its contact carrying portion with one in each of said vertical planes;

a set of movable contact assemblies, one mounted to each of said contact support members on said crossbar, each movable contact assembly having a contact blade with an inner end which extends through said horizontal axis and makes continuous, sliding electrical contact with one of said stationary connectors, and an outer end which extends from said horizontal axis, wherein said crossbar is rotatable between a closed position in which the outer ends of said contact blades make electrical contact with the stationary line contacts and an opened position in which they are spaced apart.

2. The disconnect switch as recited in claim 1 in which said crossbar includes a metal insert which is bent at each end to form said arms, and said contact support members are molded to said metal insert with an electrically insulating material.

3. The disconnect switch as recited in claim 2 in which auxiliary contact cartridges are mounted to said insert and camways are molded to said metal frame of said crossbar for operating said auxiliary contact cartridges.

4. The disconnect switch as recited in claim 2 in which said contact blades have a slot formed along an edge and said molded contact support members include a boss which is received in said slot.

5. The disconnect switch as recited in claim 4 in which a pin fastens each movable contact assembly to said contact support member.

6. The disconnect switch as recited in claim 1 in which each of said movable contact assemblies includes a second contact blade substantially the same as the first contact blade and fastened thereto with a spacer element therebetween.

7. The disconnect switch as recited in claim 6 in which first spring plates are fastened to the outer side of one contact blade in each of said movable contact assemblies and second spring plates are fastened to the outer side of the other contact blade in each of said movable contact assemblies.

8. The disconnect switch as recited in claim 7 in which each spring plate includes a first arm that extends toward the inner end of its associated contact blade and a second arm which extends toward the outer end of its associated contact blade, each of said arms including a dimple which bears against the associated contact blade to deflect the arm away therefrom and to apply a bias force thereto.

9. The disconnect switch as recited in claim 8 in which first retainer plates are fastened to the outer side of said first spring plate in each of said movable contact assemblies and second retainer plates are fastened to the outer side of said second spring plate in each of said movable contact assemblies, wherein the size of said retainer plates are selected to adjust the length over each of said first and second spring plate arms said deflection occurs.

10. A disconnect switch, the combination comprising:

a metallic mounting frame having a forward extending pair of side walls which are spaced apart to define a cavity therebetween;

a set of three substantially identical base modules molded from an electrically insulating material, said base modules being fastened to said mounting frame and aligned next to one another across the interior of said cavity;

a set of line terminal assemblies, one fastened to each of said base modules and each including a stationary line contact which extends forward from its base module;

a set of load terminal assemblies, one fastened to each of said base modules and each including a stationary connector which extends forward from its base module, said stationary connectors being aligned along a substantially horizontal pivot axis; and a crossbar assembly having a contact carrying portion which extends across the width of the disconnect switch along a longitudinal axis which is substantially parallel to and spaced from said horizontal pivot axis and having a pair of arms, one attached to each end of the contact carrying portion and extending therefrom, each of said arms being rotatably fastened to one of said pair of spaced side walls at a point along said horizontal pivot axis to enable said contact carrying portion to swing about said horizontal pivot axis, and said crossbar assembly also including a set of movable contact assemblies mounted to said contact carrying portion, one associated with each of said base modules to electrically connect its stationary line contact to its stationary connector when the crossbar assembly is in its closed position.

11. The disconnect switch as recited in claim 10 which includes a set of arc chutes, one associated with each of said base modules.

12. The disconnect switch as recited in claim 11 which includes a pair of auxiliary contact cartridge supports fastened to said back plate and disposed alongside said crossbar assembly and between said base modules.

* * * * *

UNITED STATES PATENT AND TRADEMARK OFFICE

CERTIFICATE OF CORRECTION

PATENT NO. : 4,251,700

DATED : February 17, 1981

INVENTOR(S) : Albert A. Zaffrann, et al

It is certified that error appears in the above—identified patent and that said Letters Patent is hereby corrected as shown below:

| | |
|---|---|
| Col. 4, line 28 | change "snuggly" to -- snugly -- |
| Col. 6, line 21<br>Claim 1 | change "." to -- ; -- |
| Col. 6, line 45<br>Claim 3 | change "insert" to -- frame -- and<br>change "frame" to -- insert -- |
| Col. 8, line 26<br>Claim 12 | change "back plate" to -- mounting frame -- |

Signed and Sealed this

*Twenty-second* Day of *September 1981*

[SEAL]

*Attest:*

GERALD J. MOSSINGHOFF

*Attesting Officer*

*Commissioner of Patents and Trademarks*